US006863990B2

(12) United States Patent
Wu et al.

(10) Patent No.: US 6,863,990 B2
(45) Date of Patent: Mar. 8, 2005

(54) WEAR-RESISTANT, CORROSION-RESISTANT NI-CR-MO THERMAL SPRAY POWDER AND METHOD

(75) Inventors: James B. C. Wu, St. Louis, MO (US); Matthew X. Yao, Belleville (CA)

(73) Assignee: Deloro Stellite Holdings Corporation, St. Louis, MO (US)

( * ) Notice: Subject to any disclaimer, the term of this patent is extended or adjusted under 35 U.S.C. 154(b) by 0 days.

(21) Appl. No.: 10/429,010

(22) Filed: May 2, 2003

(65) Prior Publication Data

US 2004/0219354 A1 Nov. 4, 2004

(51) Int. Cl.[7] ..... C22C 19/03; B22F 3/115; B32B 15/01; B32B 15/16

(52) U.S. Cl. ..... 428/553; 428/609; 428/612; 428/680; 420/442; 420/453; 420/455; 419/1; 419/23

(58) Field of Search ..... 428/553, 609, 428/612, 680; 420/442, 453, 455; 419/1, 23, 455, 456, 421

(56) References Cited

U.S. PATENT DOCUMENTS 4,189,130 A * 2/1980 Watanabe et al. ..... 266/270
4,453,976 A 6/1984 Smythe
4,529,616 A 7/1985 Smythe
4,649,086 A * 3/1987 Johnson ..... 428/627
4,776,070 A * 10/1988 Shibata et al. ..... 492/46
5,268,045 A * 12/1993 Clare ..... 148/518
5,496,422 A * 3/1996 Morishige et al. ..... 148/525
5,747,163 A * 5/1998 Douglas ..... 428/404
5,855,699 A * 1/1999 Oyama et al. ..... 148/519
6,082,444 A * 7/2000 Harada et al. ..... 165/133
6,162,276 A * 12/2000 Berger et al. ..... 75/252
6,376,103 B1 * 4/2002 Sampath et al. ..... 428/663
6,428,630 B1 * 8/2002 Mor et al. ..... 148/254
6,470,167 B2 * 10/2002 Hwang ..... 399/333

OTHER PUBLICATIONS

Standard Practice for Laboratory Immersion Corrosion Testing of Metals, The American Society for Testing and Materials, Designation: G 31–72, pp. 95–102, (Reapproved 1995).

* cited by examiner

*Primary Examiner*—Deborah Jones
*Assistant Examiner*—Jason L Savage
(74) *Attorney, Agent, or Firm*—Senniger Powers

(57) ABSTRACT

Enhancing wear and corrosion resistance of an industrial component by depositing a Ni-based alloy coating having a thickness of at least about 50 microns onto a surface of the industrial component by high velocity oxyfuel propulsion of a Ni-based alloy powder containing a) Cr, b) from about 15 to about 25 wt % Mo, c) no more than about 1 wt % Fe, and d) no more than about 1 wt % elements having an atomic number greater than 42. A Ni-based alloy powder for HVOF deposition containing a) Cr, b) from about 15 to about 25 wt % Mo, c) no more than about 1 wt % Fe, and d) no more than about 1 wt % elements having an atomic number greater than 42. A Ni-based coating on an industrial component having enhanced corrosion and wear resistance.

25 Claims, 5 Drawing Sheets

Spectrum: STEL-3003-1-AT0855 Range:20 keV
Total Counts=213400. Linear VS=5000
Ni
Ni
Ni
Fe
Fe
Cr
Cr
Si
Si
Mo
Mo
Mo

WEAR-RESISTANT, CORROSION-RESISTANT NI-CR-MO THERMAL SPRAY POWDER AND METHOD

BACKGROUND OF THE INVENTION

This invention relates to a method for applying a Ni-based alloy surface coating to enhance wear and corrosion resistance of components such as industrial components. The invention also relates to a Ni-based powder for application by high velocity oxyfuel deposition to impart wear and corrosion resistance.

For many components it is desirable to impart wear and/or corrosion resistance to the component surface by deposition of an alloy having enhanced resistance to these phenomena. For example, printing rolls are subject to both abrasive wear and complex corrosion by printing inks and printing substrates. And paper mill rolls are subject to abrasive wear and complex corrosion by paper bleaches and other chemicals.

High velocity oxyfuel (HVOF) deposition is an alloy deposition technique which utilizes an explosive reaction between oxygen and a fuel, such as propylene, to propel an alloy powder onto a target surface at supersonic speeds. HVOF yields coatings with high bond strength resulting from the force with which semi-molten powder particles strike the substrate surface. Such coatings typically have a microstructure consisting of splats, which are formed upon impact of the semi-molten particles on the substrate surface at high speeds. Each individual splat generally retains the original chemical composition of the particular semi-molten powder particle from which it is formed.

Metal powder formation processes typically produce powder having a given bulk composition, such as 16% Cr, 16% Mo, 4% Fe, 4% W, and balance Ni. However, the bulk powder is made up of individual powder particles, many of which have compositions varying from the bulk composition. For example, for standard alloys such as the foregoing, some particles are relatively rich in Ni, others relatively rich in Mo, some relatively rich in Cr, and still others relatively rich in Fe. The chemical compositions of the various individual powder particles are therefore heterogeneous. The varying compositions are believed to be due to violent action of high-pressure gas blowing on the molten metal stream during atomization.

This heterogeneity is tolerable in forming wrought and cast structures for which such powders are designed, because the melting of the alloy powder in the casting, or other high temperature operation eliminates such heterogeneity, and the individual particles lose their separate identities when they are melted as part of an overall bulk of material. However, with HVOF deposition, the deposit consists of a series of splats, and no overall molten bulk is ever formed. Accordingly, powder chemistry heterogeneity manifests itself as heterogeneous surface chemistry in the HVOF build up. Certain areas of an HVOF coating are therefore left vulnerable to corrosive attack, as they lack the optimal surface chemistry, that is, the design chemistry, of the alloy. For example, high-Fe content splats can be more subject to corrosion than splats having the design chemistry. Corrosion has been observed on substrates with HVOF coatings made from traditional alloy composition powders, with the ultimate result being separation of the coating from the substrate once the corrosive medium reaches the base metal.

SUMMARY OF THE INVENTION

Among the several aspects of this invention, therefore, is to provide a method for application of a coating using the HVOF process that imparts corrosion and wear resistance to the substrate, and powder compositions appropriate therefor; a method for such application which yields a surface which does not have areas of substantially weaker corrosion resistance relative to other areas on the surface.

Briefly, therefore, the invention is directed to a process for enhancing wear and corrosion resistance of an industrial component comprising by depositing a Ni-based alloy coating having a thickness of at least about 50 microns onto a surface of the industrial component by high velocity oxyfuel propulsion of a Ni-based alloy powder containing a) Cr, b) from about 15 to about 25 wt % Mo, c) no more than about 1 wt % Fe, and d) no more than about 1 wt % elements having an atomic number greater than 42.

The invention is also directed to a Ni-based alloy powder for application to industrial components by HVOF deposition to impart wear and corrosion resistance, the powder comprising about 15–25 wt % Mo, about 20–25 wt % Cr, less than about 1 wt % elements having an atomic number greater than 42, less than about 0.1 wt % C, and less than about 1 wt % Fe.

In another aspect the invention is a Ni-based HVOF coating (between about 50 and about 1250 microns thick) on an industrial component which imparts wear and corrosion resistance, and which coating has a composition, by approximate weight percent, of the following:

| | |
|---|---|
| Mo | 15–25 |
| Cr | 20–25 |
| C | less than 0.1 |
| Si | less than 0.5 |
| Fe | less than 1 |
| less than 1% of elements having an atomic number greater than 42 | |
| Ni | balance |
| and incidental impurities; | |

and the coating has corrosion resistance in reducing sulfuric acid characterized by less than about 0.20 mm/year thickness loss when tested according to ASTM specification G31-72 in a 10% $H_2SO_4$solution at boiling (about 102 C), corrosion resistance in oxidizing acid $HNO_3$ characterized by less than about 0.4 mm/year thickness when tested according to ASTM specification G31-72 in a 65% solution at 66 C, and corrosion resistance in reducing acid HCl characterized by less than about 0.1 mm/year thickness loss when tested according to ASTM specification G31-72 in a 5% HCl solution at 66 C.

Other aspects and features of the invention will be in part apparent, and in part described hereafter.

DETAILED DESCRIPTION OF CERTAIN EMBODIMENTS

Figure 1:
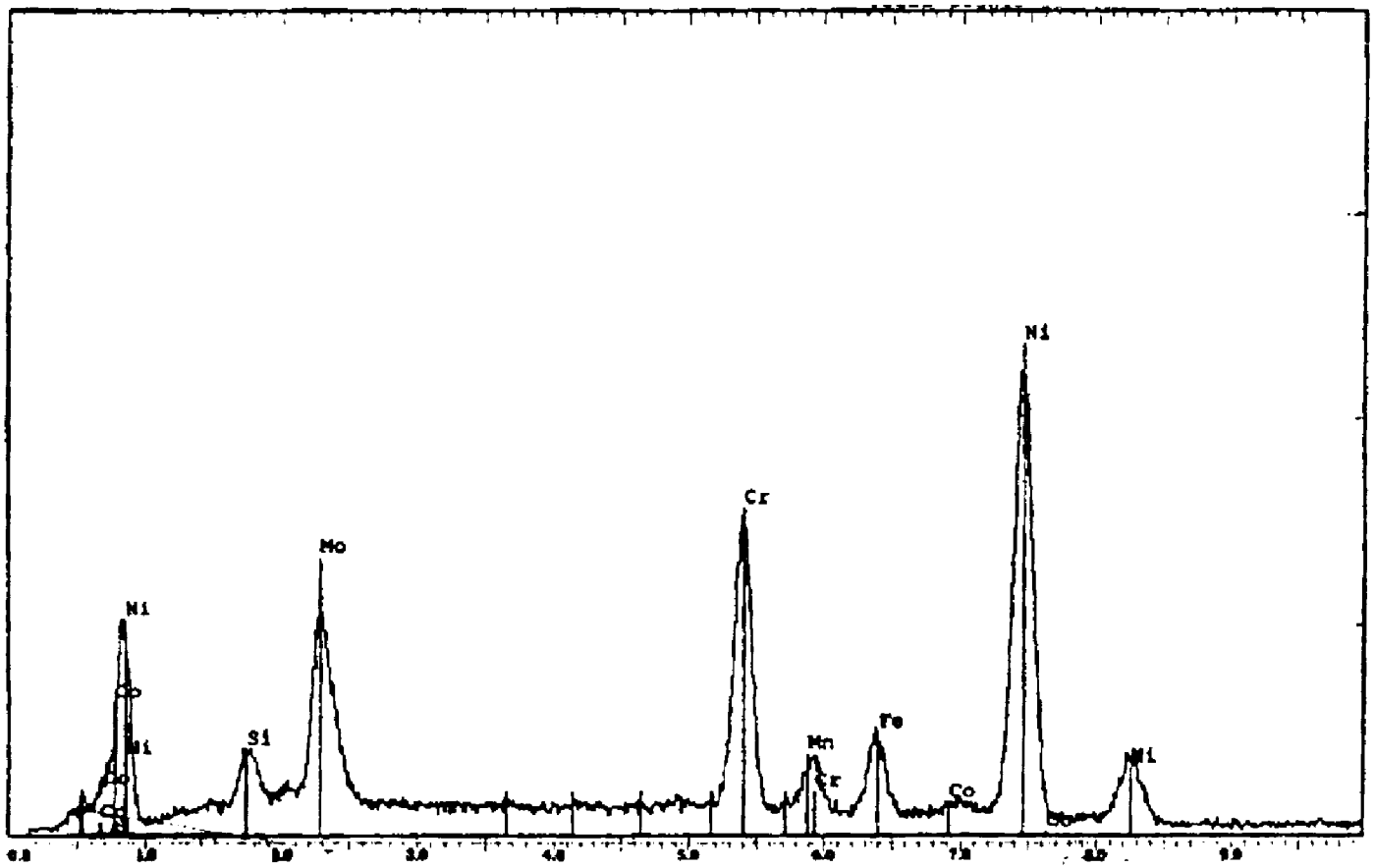
FIG. 1 is an X-ray fluorescent spectrum for a typical location on a surface prepared by HVOF deposition of Ni-16Cr-16Mo-4Fe particles.

In accordance with this invention, a build-up of a particular Ni-based alloy is applied to a substrate by HVOF to impart excellent wear and corrosion resistance. One such substrate is a printing roll, which encounters corrosion from printing inks as well as wear. Another such substrate is a paper mill roll. The coating of the invention is, for example, applied as a wear- and corrosion resistant bond coating between an alloy steel roll substrate and an outer ceramic coating of a paper mill roll.

Alloy selection has been discovered to be critical to the success of the invention, in order to create a coating which is characterized by greater chemical homogeneity than prior coatings, and to deposit a coating in which the deleterious effects of residual heterogeneity are minimized.

Nickel is the base metal in the powder used in the method of the invention because of its corrosion and wear resistance, including its high hardness value. Nickel's high hardness value contributes superior wear-resistance, and Ni is a good base metal for corrosion-resistant powder compositions because it readily alloys with corrosion-resistant metals. In one embodiment, the weight percentage of Ni in the alloy is between about 50% and about 75%. All percentages herein are by weight. In one preferred embodiment, the composition of Ni is between about 58 wt % and about 60 wt %.

Chromium is included in the present invention because of its corrosion resistance. Alloying the Ni base with Cr enhances resistance to oxidizing corrosive environments. Chromium is employed in amounts up to about 30 wt %. In one preferred embodiment, the composition of Cr is between about 20 wt % and about 25 wt %. In another preferred embodiment, the composition of chromium is between about 22 wt % and about 24 wt %.

Molybdenum is employed because when alloyed with Ni, Mo enhances resistance to corrosion in reducing environments. When alloying with both Cr and Mo, the Ni-based alloy displays resistance to complex corrosive media. Mo is employed in amounts up to about 30 wt %. In one preferred embodiment, the wt percentage of Mo in the alloy is between about 15 wt % and 25 wt %. In another preferred embodiment, the composition of Mo is between about 17 wt % and about 19 wt %.

The combination of alloying Cr and Mo in Ni imparts the corrosion resistance to complex environments, where both oxidizing corrosion and reducing corrosion reactions occur. The combined content of Cr+Mo is maintained in the range of 20 to 60 wt %. It is particularly preferred to be between about 30 and 50 wt %.

Carbon content is preferably kept to a minimum, because C tends to bond with Cr and Mo, thus preventing Cr and Mo from performing their anti-corrosive functions. Carbon thereby reduces the effective composition of Cr and Mo. Carbon cannot practically be avoided altogether because it is so ubiquitous in scraps and other materials from which alloys are made. The C content is therefore preferably maintained below about 0.1%. The best results are achieved below about 0.05 wt % C. Further, C atoms that are present can be stabilized by forming carbides with other miscellaneous elements, such as Ti, V, Zr, and Nb. In the preferred embodiment, the total composition of these miscellaneous elements is less than 5 wt %.

Figure 2:
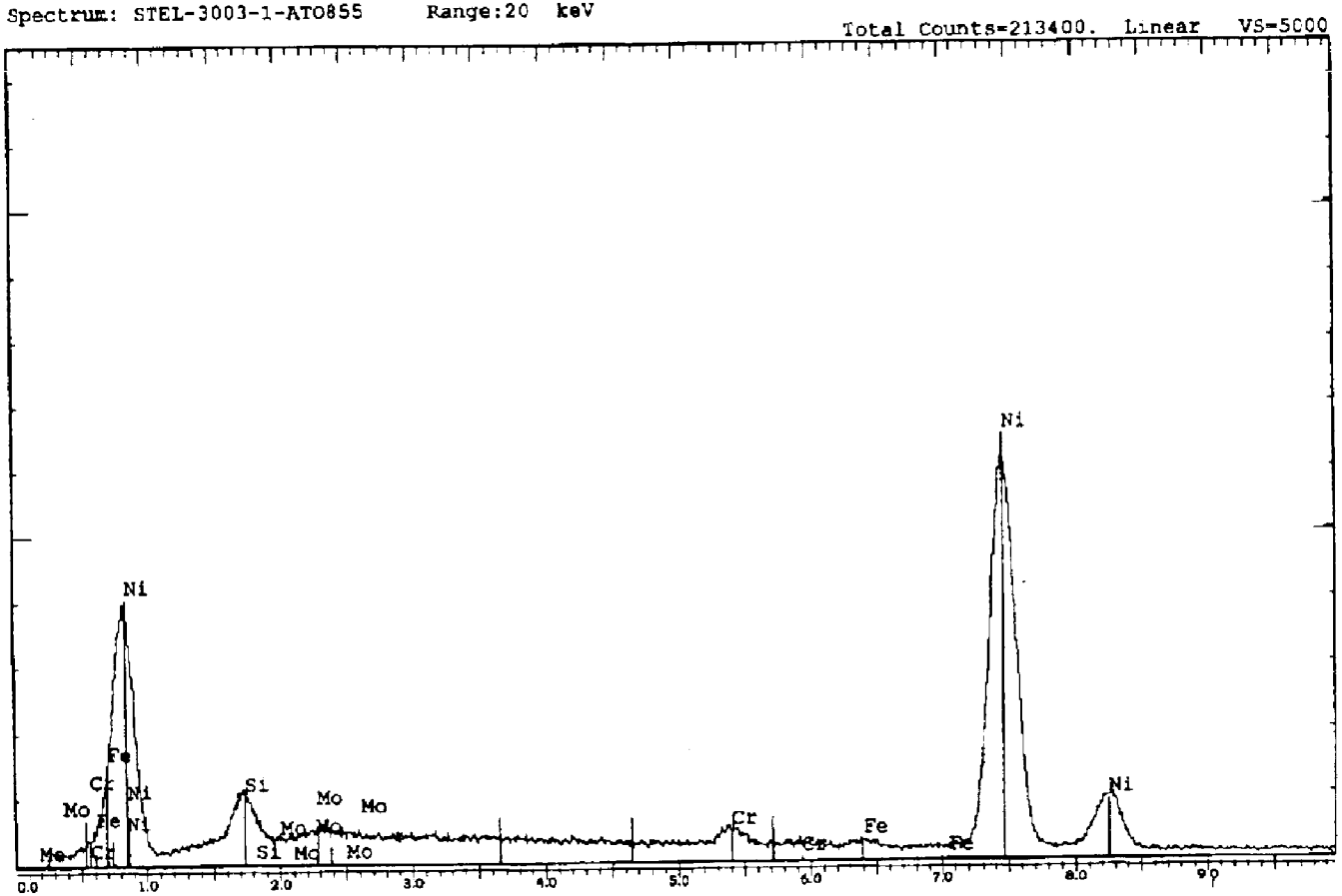
FIG. 2 is an X-ray fluorescent spectrum for a Ni-rich location on a surface prepared by HVOF deposition of Ni-16Cr-16Mo-4Fe particles.
Figure 3:
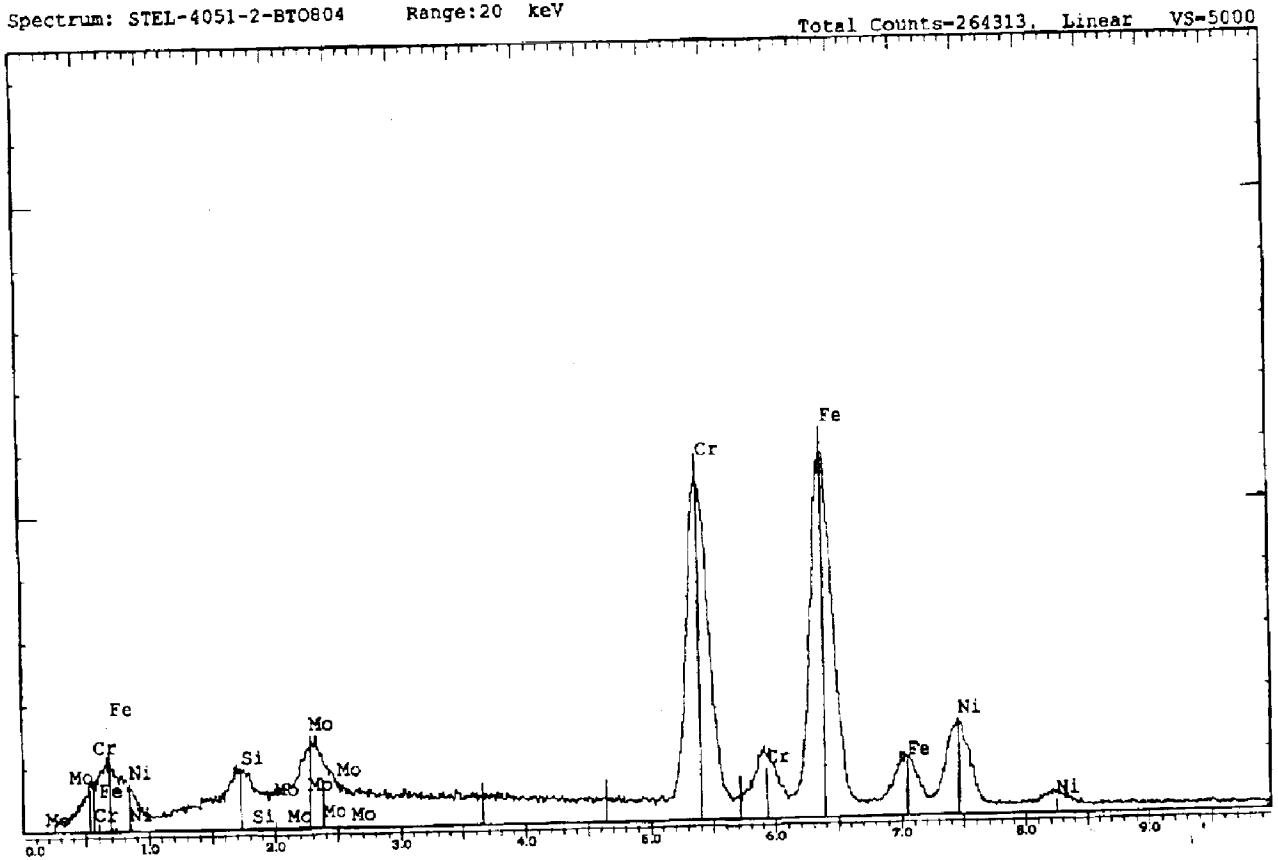
FIG. 3 is an X-ray fluorescent spectrum for a Cr— and Fe-rich area on a surface prepared by HVOF deposition of Ni-16Cr-16Mo-4Fe particles.

Iron is minimized in the alloy because Fe is especially vulnerable to corrosive attack. And it is believed higher Fe contents render alloy powders especially vulnerable to compositional segregation, and therefore chemical heterogeneity of the type discussed above which can lead a coating vulnerable to corrosive attack. In the context of a standard corrosion-resistant prior alloy such as Ni-16Cr-16Mo-4 Fe-4W, available from Stellite Coatings of Goshen, Ind., or from Haynes International of Kokomo, Ind. under the trade designation Hastelloy C, the 4% Fe content does not substantially detract from corrosion resistance, as a general proposition, when applied by techniques other than HVOF. However, when such an alloy is in atomized powder form and is applied by HVOF, there are isolated areas of substantially higher iron content. As discussed above, a typical HVOF coating of deposited Ni-16Cr-16Mo-4Fe-4W powder has areas which reflect the average overall bulk chemistry, areas which are rich in Ni, and areas which are rich in Fe. FIGS. 1–3 demonstrate spectrum for three separate areas of the same deposit, showing that there are, for example, Fe-rich areas. Even even a relatively low 4% Fe alloy powder, if applied by HVOF, will have isolated splats of substantially higher Fe, consistent with FIG. 3. And because high Fe areas are especially vulnerable to corrosive attack, Fe content is preferably maintained below about 1 wt %, still more preferably below about 0.5 wt %. In this regard the invention addresses the problem of heterogeneity by minimizing the effects of chemistry heterogeneity. In particular, minimizing Fe concentration reduces the overall negative effect because it is the Fe-rich areas which were especially vulnerable to corrosive attack. And minimizing Fe content is also believed to reduce segregation generally. Without being bound to a particular theory, it is preliminarily believed that an attraction between Fe and Cr related to the formation of gamma phase manifests itself in an exaggerated manner during powder atomization. Accordingly, Fe content is minimized to within these specified ranges by avoiding intentional Fe additions. Iron at the foregoing low levels is tolerated as an impurity to permit use of scrap in formulating the alloys.

The composition is also selected to specifically avoid elements larger than Mo. It is believed that the existence of large atoms, e.g., W, may increase the probability of forming undesirable heterogeneity in the chemical composition of the coating particles. Therefore, elements larger than Mo, i.e., those having an atomic number greater than 42, are avoided or at least minimized. Moreover, because elements having large atoms make the alloy susceptible to work hardening, avoiding such elements has the added benefit of reducing potential work hardening problems in machining and grinding. The content of elements having an atomic number greater than 42, therefore, is kept below about 1 wt %. Moreover, in a preferred embodiment, elements Zr (atomic no. 40) and Nb (41) are avoided for the same reasons as W and other large atom elements. The advantage of Mo in addressing complex corrosion in these alloys outweighs the disadvantage of its large atomic size. In an especially preferred embodiment, these elements are held to a cumulative proportion of under about 0.5 wt %.

Other incidental elements including Si and Mn are tolerated, provided they are present in a total concentration of no more than about 2 wt %. Preferably, the concentration of such incidental elements is kept below about 0.5 wt %.

Accordingly, the powder is formulated to be a Ni-based alloy with Cr and Mo as the principal alloying elements, with Fe kept below about 1 wt %, and with the content of elements having an atomic number greater than 42 kept below about 1 wt %. In one particularly preferred embodiment the C content is maintained below 0.1 wt % in order to minimize formation of Cr and Mo carbides.

As a general proposition, against the more specific above guidance, the chemical composition range for the alloy powder is as follows, by wt %

| | |
|---|---|
| Cr | up to 30 |
| Mo | 15 to 25 |
| Cr + Mo | 10–60 |
| Fe | <1 |
| C | <0.1 |
| Ni | balance |

less than about 2% incidental impurities,
and less than 1% total elements with atomic number greater than 42.

Figure 5:
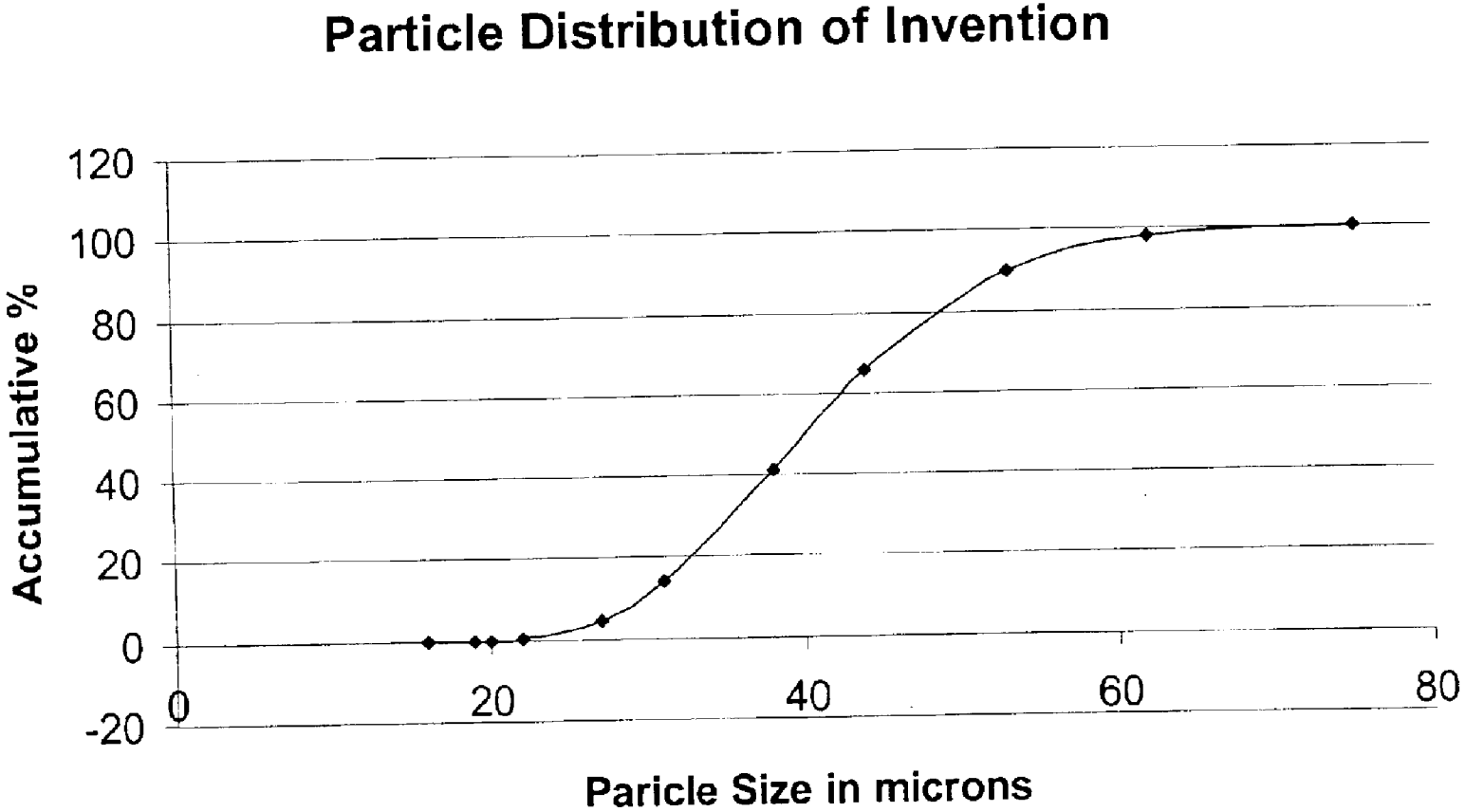
FIG. 5 is a powder particle size distribution profile

The first step in the powder manufacture process is to melt raw materials, such as shots, briquets, ingots, plates, etc. of commercially pure Cr, Mo, and Ni in the weight proportions of the desired powder composition. The molten metal is then caused to flow through a nozzle, and the molten stream is blown with high-pressure nitrogen according to standard metal alloy powder atomization techniques employing powder atomization equipment available from Osprey of the United Kingdom. The high pressure nitrogen stream passing through the gas atomization nozzle impinges upon the molten metal stream, breaking up and quenching the molten stream to form metal powder. Gas pressure is controlled because the metal powder particle size is directly related to the gas pressure; and flowrate is controlled because the ability of the molten metal to be adequately quenched is directly related to the flowrate. Gas nozzle orifice size is also controlled because it affects pressure as well as powder size. In one preferred embodiment of the invention, these parameters are selected as follows:

Nitrogen gas pressure: 250 pounds per square inch
Nitrogen gas flowrate: 69,000 standard cubic feet per hour
Molten metal flowrate: 17 pounds per minute
Pouring temperature: 3100 F
Nozzle orifice size: 5 mm The foregoing parameters are selected in this one preferred embodiment of the invention because they yield a powder with the size distribution profile illustrated in FIG. 5. The powder produced and used in accordance with this invention preferably has a size of less than about 65% less than about 45 microns. A preferred range of the powder is between about 10 and about 45 microns for at least about 60% of the powder.

In applying the metal powder to the substrate, the invention employs standard HVOF equipment such as is available from Stellite Coatings of Goshen, Ind. The equipment is operated in accordance with manufacturer guidelines. Metal powder is directed into a stream of a combusted fuel, thereby at least partly melting the powder while propelling it along the fuel stream toward the substrate at speeds on the order of several thousand feet/second, e.g., between about 4000 and 5000 feet/second. In one embodiment, continuously combusted propylene with oxygen is stored under pressure in an internal combustion chamber. From the combustion chamber, exhaust fuel is discharged through exhaust ports and into an extended nozzle. Alloy powder of the composition disclosed above is directed from a hopper or feeder into the ignited fuel steam in the nozzle. The powder particles are enveloped by the fuel stream and either melted or partially melted prior to exiting the nozzle tip. The ensuing high speed jet stream is about one half inch in diameter and travels for about six to 12 inches until it impacts the substrate. In the preferred embodiment, the nozzle is arranged so that the high velocity jet stream travels as close to perpendicular with the substrate's surface as possible. This angle of incidence provides the best coating integrity and best deposition efficiency.

The temperature of the jet stream is determined largely by the amount of fuel present in the stream and the type of fuel used. If the temperature of the fuel is too high, the service life of the torch is significantly shortened, the nozzles can become plugged, and the cost of the process will be increased as a result of the higher fuel concentration. In the present invention, the jet stream preferably reaches temperatures between 4000 F and 5000 F, based on a fuel source of propylene and oxygen.

Further, the time of application for a given surface area can affect the integrity of the final coating. If the high velocity jet stream is applied for an insufficient amount of time, the coating will not be continuous. Alternatively, if the jet stream is applied for an excessive amount of time, the process cost increases with the added use of metal powder and internal stresses build up leading to spalling of the coating. In the present invention, the high velocity jet stream is preferably applied for a time required to provide the desired coating properties characteristic of the invention, and the preferred coating of at least about 50 microns in thickness. One preferred coating has a thickness between about 2 mils and 50 mils (about 50 to about 1250 microns).

The appropriate feed rate of the metal powder into the nozzle should be closely monitored. If the feed rate is too high, the powder particles will not be sufficiently melted and, upon striking the substrate surface, will not adhere to the surface and be lost as waste. However, if the feed rate is too low, the appropriate time of application for a given surface area may be artificially high, unnecessarily increasing the amount of fuel gas required and increasing the overall cost of the process. In one embodiment of the present invention, the alloy powder is preferably fed at a rate between about 30 and 60 grams per minute.

The following example further illustrates the invention:

EXAMPLE 1

An alloy powder of the invention, called Super C, was made with the following composition by wt %:

| | |
|---|---|
| Cr | 23 |
| Mo | 18 |
| Si | 0.5 |
| C | 0.015 |
| Ni | Balance |

The powder was manufactured by melting the following raw material proportions:

Cr 115 Kg in flakes; Mo 90 Kg in pellets; Si 2.5 Kg in lumps; and Ni 292 Kg in pellets. The atomization was performed using equipment available from Stellite Coatings of Goshen, Ind. and a nozzle from Osprey of the United Kingdom. The atomization parameters were selected as follows:

Nitrogen gas pressure: 250 pounds per square inch
Nitrogen gas flowrate: 69,000 standard cubic feet per hour
Molten metal flowrate: 17 pounds per minute
Pouring temperature: 3100 F
Nozzle orifice size: 5 mm The molten metal was caused to flow through a nozzle, followed by blowing the molten stream with high-pressure nitrogen according to standard metal alloy powder atomization techniques.

A quantity of Hastelloy C powder and a quantity of the powder as prepared herein were exposed to a Fe—Nd—B magnet. Virtually none of the powder of the invention was picked up by the magnet. An appreciable quantity, estimated to be between 0.1 and 0.5%, of the Hastelloy C powder was picked up by the magnet. This demonstrates that there was appreciably more iron segregation in the Hastelloy C powder than in the powder of the invention.

Figure 4:
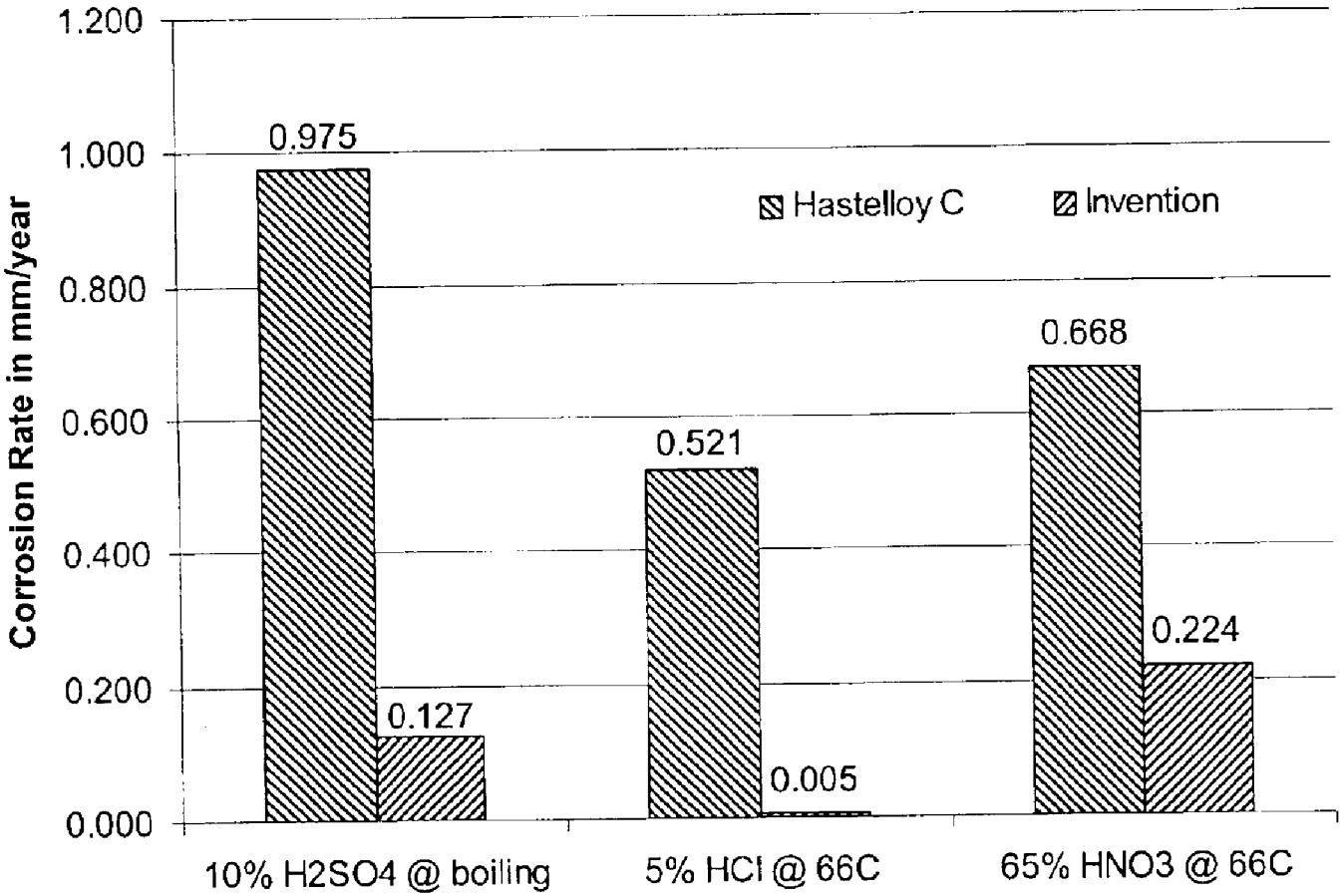
FIG. 4 is a corrosion rate comparison graph.

A quantity of the powder was then melted and deposited by plasma transferred arc (PTA) torch to a thickness of about 3.5 mm. One inch square samples were cut from the deposit as specimens for corrosion tests. For comparison, conventional Hastelloy C powder (Ni-16Cr-16Mo-4W-4Fe) was deposited by PTA and cut into one-inch square samples. The results of corrosion tests conducted according to test procedure ASTM G31-72 are illustrated in FIG. 4. These results illustrate superior corrosion resistance in both oxidizing corrosive environments ($HNO_3$) as well as reducing corrosive environments ($H_2SO_4$; HCl). In particular, the alloys demonstrate corrosion resistance in reducing sulfuric acid characterized by less than about 0.20 mm/year thickness loss when tested according to ASTM specification G31-72 in a 10% $H_2SO_4$ solution at boiling (about 102 C). The alloys also demonstrate corrosion resistance in oxidizing acid $HNO_3$ characterized by less than about 0.4 mm/year thickness when tested according to ASTM specification G31-72 in a 65% solution at 66 C. And in another aspect the alloys demonstrate corrosion resistance in reducing acid HCl characterized by less than about 0.1 mm/year thickness loss when tested according to ASTM specification G31-72 in a 5% HCl solution at 66 C.

The samples were also tested in a solution called "Green Death" consisting of, by weight, 11.5% sulfuric acid, 1.2% hydrochloric acid, 1% ferric acid, and 1% cupric chloride, to determine the critical temperature above which localized pitting corrosion occurs. The samples of the invention demonstrated a pitting temperature of 85 C, in contrast to the pitting temperature for Hastelloy C of 65 C.

What is claimed is:

1. A method for enhancing wear and corrosion resistance of an industrial component comprising depositing a Ni-based alloy coating having a thickness of at least about 50 microns onto a surface of the industrial component by high velocity oxyfuel propulsion of a Ni-based alloy powder containing a) Cr, b) from about 15 to about 25 wt % Mo, c) no more than about 1 wt % Fe, and d) no more than about 1 wt % elements having an atomic number greater than 42.

2. The method of claim 1 wherein the Ni-based alloy powder contains no more than about 0.1 wt % C.

3. The method of claim 1 wherein the Ni-based alloy powder contains between about 20 and about 25 wt % Cr.

4. The method of claim 1 wherein the Ni-based alloy powder contains between about 22 and about 24 wt % Cr.

5. The method of claim 1 wherein the Ni-based alloy powder contains between about 17 and 19 wt % Mo.

6. The method of claim 1 wherein the Ni-based alloy powder contains no more than about 0.5 wt % Si.

7. The method of claim 1 wherein the alloy powder consists essentially of, by approximate weight percent:

| | |
|---|---|
| Mo | 15–25 |
| Cr | 20–25 |
| C | less than 0.1 |
| Si | less than 0.5 |
| Fe | less than 1 |
| less than 1% of elements having an atomic number greater than 42 | |
| Ni | balance |
| and incidental impurities. | |

8. The method of claim 1 wherein the alloy powder consists essentially of, by approximate weight percent:

| | |
|---|---|
| Mo | 17–19 |
| Cr | 20–25 |
| C | less than 0.1 |
| Si | less than 0.5 |
| Fe | less than 1 |
| less than 1% of elements having an atomic number greater than 42 | |
| Ni | balance |
| and incidental impurities. | |

9. The method of claim 1 wherein the alloy powder consists essentially of, by approximate weight percent:

| | |
|---|---|
| Mo | 15–25 |
| Cr | 22–24 |
| C | less than 0.1 |
| Si | less than 0.5 |
| Fe | less than 1 |
| less than 1% of elements having an atomic number greater than 42 | |
| Ni | balance |
| and incidental impurities. | |

10. The method of claim 1 wherein the alloy powder consists essentially of, by approximate weight percent:

| | |
|---|---|
| Mo | 17–19 |
| Cr | 22–24 |
| C | less than 0.1 |
| Si | less than 0.5 |
| Fe | less than 1 |
| less than 1% of elements having an atomic number greater than 42 | |
| Ni | balance |
| and incidental impurities. | |

11. The method of claim 1 wherein the alloy powder consists essentially of, by approximate weight percent:

| | |
|---|---|
| Mo | 15–25 |
| Cr | 20–25 |
| C | less than 0.1 |
| Si | less than 0.5 |
| Fe | less than 0.5 |
| less than 1% of elements having an atomic number greater than 42 | |
| Ni | balance |
| and incidental impurities. | |

12. The method of claim 1 wherein the alloy powder consists essentially of, by approximate weight percent:

| | |
|---|---|
| Mo | 17–19 |
| Cr | 20–25 |
| C | less than 0.1 |
| Si | less than 0.5 |
| Fe | less than 0.5 |
| less than 1% of elements having an atomic number greater than 42 | |
| Ni | balance |
| and incidental impurities. | |

13. The method of claim 1 wherein the alloy powder consists essentially of, by approximate weight percent:

| | |
|---|---|
| Mo | 15–25 |
| Cr | 22–24 |
| C | less than 0.1 |
| Si | less than 0.5 |
| Fe | less than 0.5 |
| less than 1% of elements having an atomic number greater than 42 | |
| Ni | balance |
| and incidental impurities. | |

14. The method of claim 1 wherein the alloy powder consists essentially of, by approximate weight percent:

| | |
|---|---|
| Mo | 17–19 |
| Cr | 22–24 |
| C | less than 0.1 |
| Si | less than 0.5 |
| Fe | less than 0.5 |
| less than 1% of elements having an atomic number greater than 42 | |
| Ni | balance |
| and incidental impurities. | |

15. A Ni-based alloy powder for application to industrial components by HVOF deposition to impart wear and corrosion resistance, the powder comprising about 15–25 wt % Mo, about 20–25 wt % Cr, less than about 1 wt % elements having an atomic number greater than 42, less than about 0.1 wt % C, and less than about 1 wt % Fe.

16. The Ni-based alloy powder of claim 15 consisting essentially of, by approximate weight percent:

| | |
|---|---|
| Mo | 15–25 |
| Cr | 20–25 |
| C | less than 0.1 |
| Si | less than 0.5 |
| Fe | less than 1 |
| less than 1% of elements having an atomic number greater than 42 | |
| Ni | balance |
| and incidental impurities. | |

17. The Ni-based alloy powder of claim 15 consisting essentially of, by approximate weight percent:

| | |
|---|---|
| Mo | 17–19 |
| Cr | 20–25 |
| C | less than 0.1 |
| Si | less than 0.5 |
| Fe | less than 1 |
| less than 1% of elements having an atomic number greater than 42 | |
| Ni | balance |
| and incidental impurities. | |

18. The Ni-based alloy powder of claim 15 consisting essentially of, by approximate weight percent:

| | |
|---|---|
| Mo | 15–25 |
| Cr | 22–24 |
| C | less than 0.1 |
| Si | less than 0.5 |
| Fe | less than 1 |
| less than 1% of elements having an atomic number greater than 42 | |

-continued

| | |
|---|---|
| Ni | balance |
| and incidental impurities. | |

19. The Ni-based alloy powder of claim 15 consisting essentially of, by approximate weight percent:

| | |
|---|---|
| Mo | 17–19 |
| Cr | 22–24 |
| C | less than 0.1 |
| Si | less than 0.5 |
| Fe | less than 1 |
| less than 1% of elements having an atomic number greater than 42 | |
| Ni | balance |
| and incidental impurities. | |

20. The Ni-based alloy powder of claim 15 consisting essentially of, by approximate weight percent:

| | |
|---|---|
| Mo | 15–25 |
| Cr | 20–25 |
| C | less than 0.1 |
| Si | less than 0.5 |
| Fe | less than 0.5 |
| less than 1% of elements having an atomic number greater than 42 | |
| Ni | balance |
| and incidental impurities. | |

21. The Ni-based alloy powder of claim 15 consisting essentially of, by approximate weight percent:

| | |
|---|---|
| Mo | 17–19 |
| Cr | 20–25 |
| C | less than 0.1 |
| Si | less than 0.5 |
| Fe | less than 0.5 |
| less than 1% of elements having an atomic number greater than 42 | |
| Ni | balance |
| and incidental impurities. | |

22. The Ni-based alloy powder of claim 15 consisting essentially of, by approximate weight percent:

| | |
|---|---|
| Mo | 15–25 |
| Cr | 22–24 |
| C | less than 0.1 |
| Si | less than 0.5 |
| Fe | less than 0.5 |
| less than 1% of elements having an atomic number greater than 42 | |
| Ni | balance |
| and incidental impurities. | |

23. The Ni-based alloy powder of claim 15 consisting essentially of, by approximate weight percent:

| | |
|---|---|
| Mo | 17–19 |
| Cr | 22–24 |
| C | less than 0.1 |
| Si | less than 0.5 |
| Fe | less than 0.5 |
| less than 1% of elements having an atomic number greater than 42 | |

-continued

| | |
|---|---|
| Ni | balance |
| and incidental impurities. | |

24. The Ni-based alloy powder of claim 15 having a size of at least 60% between about 10 microns and about 45 microns.

25. A Ni-based coating on an industrial component which imparts wear and corrosion resistance, and which coating has a composition, by approximate weight percent, of the following:

| | |
|---|---|
| Mo | 15–25 |
| Cr | 20–25 |
| C | less than 0.1 |
| Si | less than 0.5 |
| Fe | less than 1 |
| less than 1% of elements having an atomic number greater than 42 | |

-continued

| | |
|---|---|
| Ni | balance |
| and incidental impurities; | |

wherein the coating has corrosion resistance in reducing sulfuric acid characterized by less than about 0.20 mm/year thickness loss when tested according to ASTM specification G31-72 in a 10% $H_2SO_4$ solution at boiling (about 102 C), corrosion resistance in oxidizing acid $HNO_3$ characterized by less than about 0.4 mm/year thickness when tested according to ASTM specification G31-72 in a 65% solution at 66 C, and corrosion resistance in reducing acid HCl characterized by less than about 0.1 mm/year thickness loss when tested according to ASTM specification G31-72 in a 5% HCl solution at 66 C;

wherein the coating has a thickness between about 50 and about 1250 microns; and wherein the coating is deposited by HVOF deposition.

* * * * *